United States Patent [19]

Morishita et al.

[11] Patent Number: 4,942,307

[45] Date of Patent: Jul. 17, 1990

[54] ENGINE STARTER APPARATUS

[75] Inventors: Akira Morishita; Shuzoo Isozumi, both of Himeji, Japan

[73] Assignee: Mitsubishi Denki Kabushiki Kaisha, Tokyo, Japan

[21] Appl. No.: 284,029

[22] Filed: Dec. 14, 1988

[30] Foreign Application Priority Data

Dec. 24, 1987 [JP] Japan ..... 62-199048

[51] Int. Cl.[5] ..... F02N 11/08

[52] U.S. Cl. ..... 290/38 R; 123/179 G

[58] Field of Search ..... 318/38 R, 38 C, 38 E, 318/DIG. 1, DIG. 3, 273, 275, 364; 123/179 G

[56] References Cited

U.S. PATENT DOCUMENTS

| | | | |
|---|---|---|---|
| 2,440,849 | 5/1948 | Defandorf et al. | 318/275 X |
| 3,293,525 | 12/1966 | Haupt | 318/275 X |
| 3,319,143 | 5/1967 | Kanada | 318/275 |
| 4,291,653 | 9/1981 | Tucker | 123/179 BG |
| 4,559,455 | 12/1985 | Tanaka | 290/38 R |

*Primary Examiner*—A. D. Pellinen
*Assistant Examiner*—W. E. Duncanson, Jr.
*Attorney, Agent, or Firm*—Sughrue, Mion, Zinn, Macpeak & Seas

[57] ABSTRACT

An engine starter apparatus comprising an electric source, a starter motor connected to the electric source, a solenoid switch connected between the electric source and the starter motor, and a supplemental fuel supplier connected in parallel to the starter motor for supplying additional fuel to the engine to be started. The solenoid switch is movable between a closed position in which the electric source is connected to the starter motor and an open position in which the electric source is disconnected from the starter motor. The supplemental fuel supplier is actuated when the starter motor is energized. A short-circuiting additional switch operated by the solenoid switch is connected between the starter motor and the ground for short circuiting the starter motor when the solenoid switch is in the open position, ensuring that the supplemental fuel supplier is energized only while the starter motor is energized.

3 Claims, 2 Drawing Sheets

ENGINE STARTER APPARATUS

BACKGROUND OF THE INVENTION

This invention relates to an engine starter apparatus and more particularly to an engine starter apparatus having a supplemental fuel supplying device.

FIG. 1 is a circuit diagram of a conventional engine starter apparatus of the type to which the present invention is applicable. In FIG. 1, an electrical source 1 is connected at its positive terminal to a starter switch 2 as well as to a first stationary contact 4*a* of a solenoid switch 3. The electrical source 1 has its negative terminal connected to earth. The starter switch 2 is connected between a current coil 5 and a voltage coil 6 of the solenoid switch 3. The other end of the current coil 5 is connected to a second stationary contact 4*b* of the solenoid switch 3. The other end of the voltage coil 6 is connected to earth. The solenoid switch 3 has a plunger 4 with a movable bridge contact 4*c* biased in its open position by an unillustrated spring. The movable contact 4*c* constitutes, together with the stationary contacts 4*a* and 4*b*, a normally-open contact. The engine starter apparatus further comprises a starter motor 7 which preferably is a permanent magnet type starter motor connected to the second stationary contact 4*b* at one side. The other side of the starter motor 7 is grounded. Also connected between the second stationary contact 4*b* of the solenoid switch 3 and the earth in parallel to the starter motor 7 is a supplemental fuel supplier 8 which is an electric unit for supplying an additional amount of fuel to the engine only during the starting of the engine.

When it is desired to start the engine, the starter switch 2 is closed to energize the current coil 5 and the voltage coil 6 of the solenoid switch 3. While the starter motor 7 and the supplemental fuel supplier 8 are energized by the current through the current coil 5 at this time, the current is not sufficiently high to actuate them. Only after the movable contact 4*c* of the solenoid switch 3 has been brought into the closed position, are the starter motor 7 and the supplemental fuel supplier 8 driven to start the engine. When the engine has been started, and the starter switch 2 is open, the movable contact 4*c* returns to its open position, whereupon the starter motor 7 and the supplemental fuel supplier 8 are deenergized.

With the conventional engine starter apparatus as above described, the starter motor 7 cannot immediately come to a complete stop and rotates for a moment due to the inertia of the rotor even when the current flowing to the motor is interrupted. Accordingly, the rotation of the starter motor 7 generates electric power, particularly with the permanent magnet type starter motor in which excitation is achieved by permanent magnets. This electric power causes the supplemental fuel supplier to be driven to feed an unnecessary amount of fuel to the engine.

The waveforms of FIG. 2 illustrate the above discussed problem in the engine starter apparatus with a supplemental fuel supplier. Waveform (a) shows the operation of the solenoid switch 3, waveform (b) shows the terminal voltage of the starter motor 7, and waveform (c) shows the operation of the supplemental fuel supplier 8. As seen from the waveforms (a) to (c), the solenoid switch 3 is turned on at a time point $t_1$, at which the starter motor 7 and the supplemental fuel supplier 8 are turned on. Then, the starter motor 7 cranks the engine until it is started up at a time point $t_2$. Since there is no load on the starter motor 7 after the engine is started, the terminal voltage increases and an overrunning condition occurrs. At a time point $t_3$, the solenoid switch 3 is turned off, so that the source voltage is removed from both the starter motor 7 and the supplemental fuel supplier 8. However, since the starter motor 7 cannot immediately come to a complete stop, it continues to rotate by its own inertia until a time point $t_4$ and generates gradually decreasing electric power during the time period from $t_3$ to $t_4$ at which no voltage is generated by the starter motor 7. This voltage generated by the starter motor 7 appears at the motor terminal which is connected to the supplemental fuel supplier 8. Therefore, as seen from the waveform (c), the supplemental fuel supplier 8 is kept running by the voltage generated by the starter motor 7 even after the engine has been started and the solenoid switch 3 has been turned off at the time point $t_3$ until the starter motor 7 comes to a complete stop at the time point $t_4$.

Thus, the operation of the supplemental fuel supplier 8 during the time period from $t_3$ to $t_4$ is undesirable in that it causes a waste of fuel.

In order to simply shorten this undesirable time period, the operating voltage of the supplemental fuel supplier 8 may be set at a higher voltage so that the supplemental fuel supplier 8 is operated only when a relatively high voltage appears at the terminal of the starter motor 7. However, this measure is not practical because the cranking voltage at which the starter motor 7 is cranked can vary a great deal according to engine conditions and/or battery conditions, and the voltage applied to the supplemental fuel supplier 8 may not reach the set voltage value necessary for the supplemental fuel supplier 8 to be driven. Accordingly, the operating voltage for the supplemental fuel supplier 8 must be set at zero volts.

SUMMARY OF THE INVENTION

Accordingly, an object of the present invention is to provide an engine starter apparatus in which unnecessary operation of the supplemental fuel supplier unit is eliminated.

Another object of the present invention is to provide an engine starter apparatus in which unnecessary fuel supply is eliminated.

With the above objects in view, the engine starter apparatus of the present invention comprises an electric source, a starter motor connected to the electric source, a solenoid switch connected between the electric source and the starter motor, and a supplemental fuel supplier connected in parallel to the starter motor for supplying additional fuel to the engine to be started. The solenoid switch is movable between a closed position in which the electric source is connected to the starter motor and an open position in which the electric source is disconnected from the starter motor. The supplemental fuel supplier is actuated when the starter motor is energized. An additional, short-circuiting switch operated by the solenoid switch is connected between the starter motor and ground for short circuiting the starter motor when the solenoid switch is in the open position, ensuring that the supplemental fuel supplier is energized only when the starter motor is energized.

BRIEF DESCRIPTION OF THE DRAWING

The present invention will become more readily apparent from the following detailed description of the preferred embodiment of the present invention taken in conjunction with the accompanying drawings, in which.

DESCRIPTION OF THE PREFERRED EMBODIMENT

Figure 3:
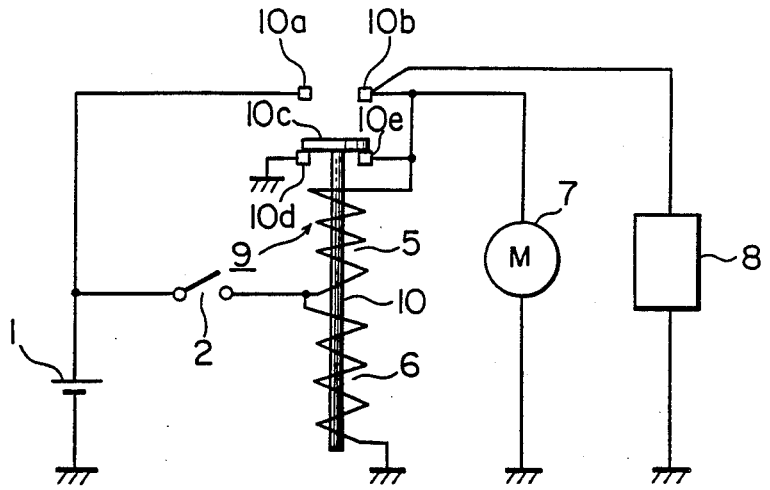
FIG. 3 is a schematic circuit diagram showing one embodiment of the engine starter with a supplemental fuel supplying unit of the present invention.

FIG. 3 illustrates, in a schematic circuit diagram, an engine starter apparatus with a supplemental fuel supplying unit of the present invention. The engine starter apparatus comprises an electrical source 1 in the form of a battery connected at its positive terminal to a starter switch 2 as well as to a first stationary contact 10*a* of a solenoid switch 9. The electrical source 1 has its negative terminal connected to earth. The starter switch 2 is connected between a current coil 5 and a voltage coil 6 of the solenoid switch 9. The other end of the current coil 5 is connected to a second stationary contact 10*b* of the solenoid switch 9. The other end of the voltage coil 6 is connected to earth. The solenoid switch 9 has a plunger 10 with a movable bridge contact 10*c* biased in its open position by an unillustrated spring. The movable contact 10*c* constitutes, together with the stationary contacts 10*a* and 10*b* which constitute a first pair of stationary contacts, a normally-open contact which is in an illustrated open position when the solenoid switch 9 is deenergized.

The engine starter apparatus further comprises a starter motor 7 connected to the second stationary contact 10*b* at one side. It is to be noted that the present invention is very effective and useful when it is applied to a permanent magnet type starter motor. The other side of the starter motor 7 is grounded. Also connected between the second stationary contact 10*b* of the solenoid switch 3 and earth in parallel to the starter motor 7 is a supplemental fuel supplier 8 which is an electric unit for supplying an additional amount of fuel to the engine only during the starting up of the engine.

According to the present invention, the solenoid switch 9 further comprises a second pair of stationary contacts 10*d* and 10*e*. The stationary contact 10*d* is connected to earth and the stationary contact 10*e* is connected to the starter motor 7. The second pair of stationary contacts 10*d* and 10*e* are electrically connectable by the bridging movable contact 10*c*, together forming a normally-closed switch. When the solenoid switch 9 is deenergized, this normally-closed switch composed of the movable contact 10*c*, two stationary contacts 10*d* and 10*e* is closed to connect the starter motor 7 to earth. In this context, this normally-closed switch is a short-circuiting switch for short-circuiting the starter motor when the solenoid switch is in the open position.

When it is desired to start the engine, the starter switch 2 is closed to energize the current coil 5 and the voltage coil 6 of the solenoid switch 9. While the starter motor 7 and the supplemental fuel supplier 8 are energized by the current through the current coil 5 at this time, the current is not sufficiently high to actuate them. Only after the movable contact 10*c* of the solenoid switch 9 has been brought into the closed position, are the starter motor 7 and the supplemental fuel supplier 8 driven to start the engine. When the engine has been started, and the starter switch 2 is open, the movable contact 10*c* returns to its open position, whereupon the starter motor 7 and the supplemental fuel supplier 8 are deenergized to come to a stop.

Figure 4:
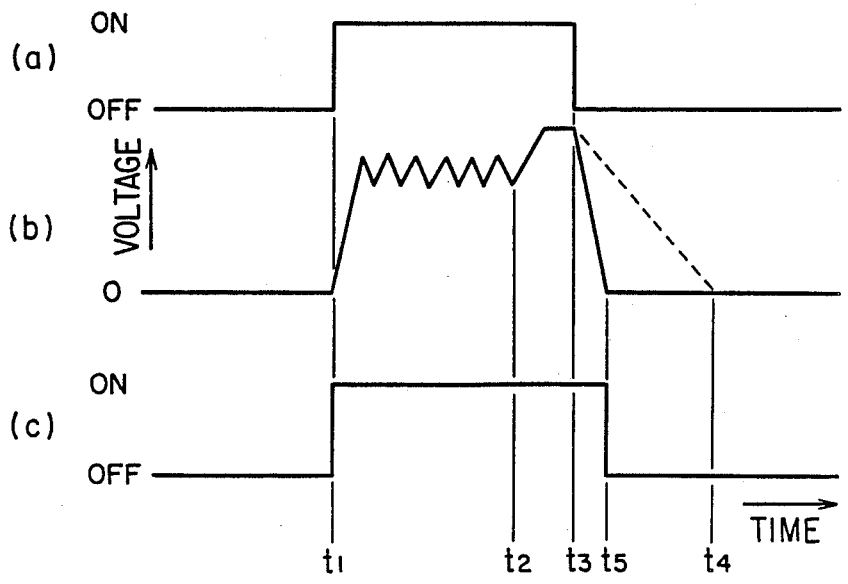
FIG. 4 is a graph showing the operation of the engine starter shown in FIG. 3.

The waveforms of FIG. 4 illustrate the operation of the engine starter of the present invention shown in FIG. 3. Waveform (a) shows the operation of the solenoid switch 9, waveform (b) shows the terminal voltage of the starter motor 7, and waveform (c) shows the operation of the supplemental fuel supplier 8. As seen from the waveforms (a) to (c), the solenoid switch 9 is turned on at a time point $t_1$, at which time the starter motor 7 and the supplemental fuel supplier 8 are turned on. Then, the starter motor 7 cranks the engine until it is started at a time point $t_2$. Since there is no load on the starter motor 7 after the engine is started, the terminal voltage increases and an overrunning condition occurrs. At a time point $t_3$, the solenoid switch 9 is turned off, so that the source voltage is removed from both the starter motor 7 and the supplemental fuel supplier 8.

Figure 1:
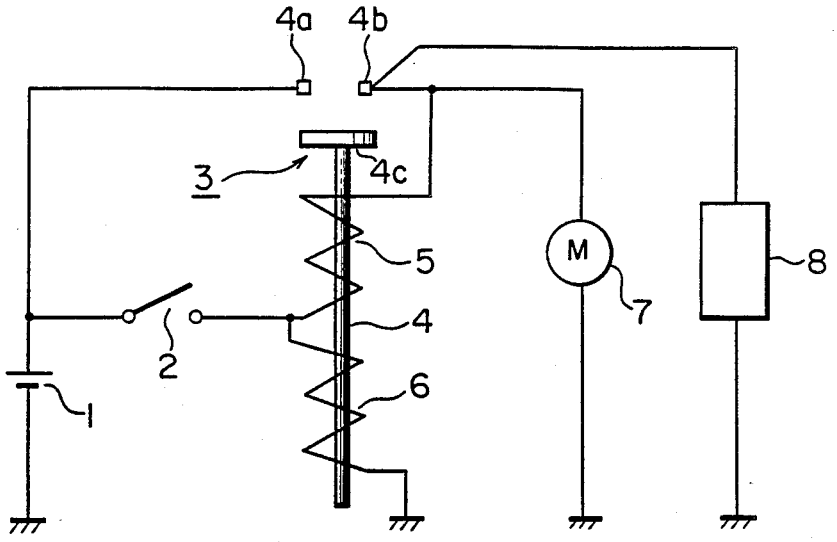
FIG. 1 PRIOR ART
FIG. 1 is a schematic circuit diagram showing a conventional engine starter with a supplemental fuel supplying unit.
Figure 2:
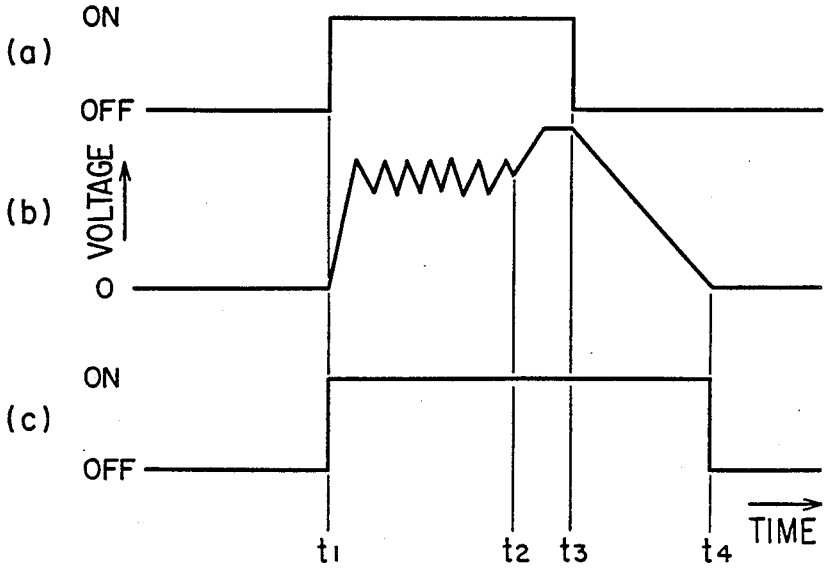
FIG. 2 PRIOR ART
FIG. 2 is a graph showing the operation of the engine starter shown in FIG. 1.

However, since the starter motor 7 cannot immediately come to a complete stop and continues to rotate by its own inertia until a time point $t_4$, it generates gradually decreasing electric power during the time period from $t_3$ to $t_4$ as shown by the dotted line. However, this voltage generated by the starter motor 7 is short-circuited by the second contacts 10*c*, 10*d* and 10*e* which are now closed as shown in FIG. 1. Accordingly, as seen from the waveform (b), the voltage at the starter motor terminal rapidly decreases to zero during a short time period from $t_3$ to $t_5$, so that the supplemental fuel supplier 8 is only kept running by this voltage during this short period of time. Thus, it is apparent that the unnecessary operation of the supplemental fuel supplier 8 and therefore the waste of fuel during the time period from $t_5$ to $t_4$ is eliminated.

As has been described, according to the present invention, the engine starter apparatus of the present invention is provided with a short-circuiting additional switch operated by the solenoid switch between the starter motor and the ground for short circuiting the starter motor when the solenoid switch is in the open position, ensuring that the voltage generated by the starter motor during its inertial rotation is shorted out so that the supplemental fuel supplier is energized only while the starter motor is energized.

What is claimed is:

1. An engine starter apparatus comprising an electric source;

a starter motor connected to said electric source;

a solenoid switch connected between said electric source and said starter motor, said solenoid switch being movable between a closed position in which said electric source is connected to said starter motor and an open position in which said electric source is disconnected from said starter motor;

a supplemental fuel supplier connected in parallel to said starter motor for supplying additional fuel to the engine when said starter motor is energized; and short-circuiting means connected to said starter motor for directly short circuiting said starter motor when said solenoid switch is in said open position.

2. An engine starter apparatus as claimed in claim 1, wherein said solenoid switch comprises a first pair of separable contacts connected between said starter motor and said electric source and a second pair of separable contacts connected between said starter motor and the ground, said short-circuit means comprising said second contact pair.

3. An engine starter apparatus as claimed in claim 1, wherein said starter motor is a permanent magnet type starter motor.

* * * * *